US007820610B2

(12) United States Patent
Showell et al.

(10) Patent No.: US 7,820,610 B2
(45) Date of Patent: Oct. 26, 2010

(54) LAUNDRY DETERGENT CONTAINING POLYETHYLENEIMINE SUDS COLLAPSER

(75) Inventors: Michael Stanford Showell, Beijing (CN); Ming Tang, Beijing (CN); Frank Hulskotter, Bad Duerkheim (DE); Haiyan Song, Beijing (CN); James Lee Danziger, Mason, OH (US); Christofer Arisandy, Mannheim-Baden-Wurttemberg (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/416,294

(22) Filed: Apr. 1, 2009

(65) Prior Publication Data

US 2010/0170045 A1 Jul. 8, 2010

Related U.S. Application Data

(60) Provisional application No. 61/123,310, filed on Apr. 7, 2008.

(51) Int. Cl.
*C11D 3/30* (2006.01)
*C11D 1/722* (2006.01)

(52) U.S. Cl. ..... 510/289; 510/276; 510/317; 510/341; 510/350; 510/421; 510/422; 510/423; 510/433

(58) Field of Classification Search ..... 510/276, 510/289, 317, 341, 350, 421, 422, 423, 433
See application file for complete search history.

(56) References Cited

U.S. PATENT DOCUMENTS

| | | | | |
|---|---|---|---|---|
| 3,929,678 | A | 12/1975 | Laughlin et al. | |
| 5,565,145 | A * | 10/1996 | Watson et al. | 510/350 |
| 5,968,893 | A | 10/1999 | Manohar et al. | |
| 6,008,181 | A | 12/1999 | Cripe et al. | |
| 6,020,303 | A | 2/2000 | Cripe et al. | |
| 6,060,443 | A | 5/2000 | Cripe et al. | |
| 6,300,304 | B1 * | 10/2001 | Boeckh et al. | 510/475 |
| 2004/0192568 | A1 * | 9/2004 | Yates et al. | 510/276 |
| 2004/0266653 | A1 * | 12/2004 | Delplancke et al. | 510/470 |
| 2006/0089294 | A1 * | 4/2006 | Depoot et al. | 510/515 |
| 2006/0128594 | A1 * | 6/2006 | Yates et al. | 510/445 |
| 2007/0275868 | A1 * | 11/2007 | Cooremans et al. | 510/475 |
| 2008/0015135 | A1 * | 1/2008 | de Buzzaccarini et al. | 510/336 |
| 2008/0171684 | A1 * | 7/2008 | Boutique et al. | 510/299 |
| 2008/0178396 | A1 * | 7/2008 | van der Linden et al. | 8/137 |
| 2008/0318832 | A1 * | 12/2008 | Gardner et al. | 510/434 |
| 2009/0014029 | A1 * | 1/2009 | Borne | 134/6 |
| 2009/0105109 | A1 * | 4/2009 | Lant et al. | 510/320 |
| 2009/0124531 | A1 * | 5/2009 | Danziger et al. | 510/350 |
| 2009/0186796 | A1 * | 7/2009 | Gomez Ruiz et al. | 510/237 |

FOREIGN PATENT DOCUMENTS

| | | | |
|---|---|---|---|
| AU | 1781395 | A1 | 12/1995 |
| DE | 29825083 | U1 | 9/2004 |
| WO | WO 9907815 | A1 | 2/1999 |
| WO | WO 2006/108856 | A3 | 1/2007 |

OTHER PUBLICATIONS

PCT International Search Report dated Jul. 1, 2009—5 pgs.

* cited by examiner

*Primary Examiner*—Charles I Boyer
(74) *Attorney, Agent, or Firm*—Julie A. McConihay; David V. Upite; Leonard W. Lewis

(57) ABSTRACT

An alkaline laundry detergent for hand washing a fabric contains a sudsing surfactant, a polyethyleneimine suds collapser having the empirical formula $(PEI)_a(EO)_b(PO)_c$ where a is about 100-100,000, b is about 0-60, and c is about from 0-60, and a pH control system When diluted to form a laundry liquor and during washing the pH control system maintains the pH of the laundry liquor above about 8.

10 Claims, No Drawings

LAUNDRY DETERGENT CONTAINING POLYETHYLENEIMINE SUDS COLLAPSER

FIELD OF THE INVENTION

The present invention relates to laundry detergents. Specifically, the present invention relates to laundry detergents containing a suds collapser.

BACKGROUND OF THE INVENTION

Laundry detergents have been known for many years which contain surfactants, typically anionic surfactants, for cleaning fabrics such as clothing. Laundry detergents typically create suds during use in both hand-wash and automatic washing machine use. Especially during hand washing of clothes and fabrics, where the user is very involved with the washing process, a large volume of suds is initially desirable as it indicates to the user that sufficient surfactant is present, working and cleaning the fabrics.

However, while a large volume of suds is desirable during cleaning, it paradoxically typically takes between 3-6 rinses to remove such suds to the satisfaction of the person washing.

This adds up to a great amount of water which is used every day for rinsing around the world—typically about 5-10 tons of water per year per household in hand wash countries such as India, China, etc. As water is often a limited resource, especially in hand washing countries, the use of water for rinsing reduces the amount available for other possible uses, such as irrigation, drinking, bathing, etc. Depending on the location and the local practice, there may also be an added energy or labor cost involved with rinsing so many times and with so much water.

Suds suppressors are well-known in, for example, automatic dishwashing detergents and laundry detergents for front-loading washing machines. However, in a hand wash situation, the consumers are used to seeing suds during the wash, and if no suds are present, then consumers think that the laundry detergent contains insufficient surfactant to perform up to expectations. As typical suds suppressors do not distinguish between the wash and rinse conditions, they do not solve the problem of providing suds during use and yet reducing the need for rinsing.

During the rinse cycle, the typical laundry hand washer believes that if suds are still present, then there is surfactant residue that remains on the clothes, and therefore the clothes are not yet "clean" until the suds are not seen in the rinse. However, it has been found that fewer rinses can sufficiently remove surfactants and thus multiple rinsing is not needed. So, it has surprisingly been found that if consumer perception can be overcome, rinsing can be reduced with little or no adverse effects to the typical hand wash user, or fabrics.

Fabric treatment compositions and general use detergents have described, for example, the use of fatty acids in an acidic composition to allegedly initiate suds collapse in the rinse. However, such detergents would inherently possess impaired cleaning as compared to alkaline detergents and/or those which form an alkaline laundry liquor during use. This is because many typical fabric soils and stains are greasy soils. Alkaline conditions loosen up such soils and stains and therefore inherently clean such stains more efficiently. Thus, in an acidic composition containing a fatty acid, the cleaning efficiency and effectiveness are sacrificed in return for an alleged reduced need for rinsing. It is desirable to increase cleaning efficiency and effectiveness.

In addition, it is recognized that polyethyleneimine polymers in general are well known for use in detergents including laundry detergents. However, their use has typically been for their soil dispersancy and anti-redeposition properties.

Accordingly, as in many countries water and other resources is becoming ever more scarce the need exists for an effective way to reduce the amount of water used for rinsing during laundry without sacrificing cleaning efficiency and effectiveness.

SUMMARY OF THE INVENTION

The present invention relates to an alkaline laundry detergent for hand washing a fabric contains a sudsing surfactant, a polyethyleneimine suds collapser having the empirical formula $(PEI)_a(EO)_b(PO)_c$ where a is about 100-100,000, b is about 0-60, and c is about from 0-60, and a pH control system When diluted to form a laundry liquor and during washing the pH control system maintains the pH of the laundry liquor above about 8. Also described herein is a method for hand washing by using the laundry detergent herein.

It has now been found that the invention can provide the level of cleaning expected with modern detergents and yet also induce users to reduce the number of rinses and thereby save water, effort, resources, etc. Without intending to be limited by theory, it is believed that the anionic surfactant provides excellent cleaning as well as sudsing during the wash cycle. The polyethyleneimine suds collapser is typically activated by the pH drop during the rinse such that the now protonated amines attract and/or complex with the anionic surfactant during the rinse. This in turn removes anionic surfactant from the air water interface and helps promote suds collapse. The collapse of the suds in the rinse promotes a reduced need for rinsing, and may in turn save significant effort, water, and/or other resources.

DETAILED DESCRIPTION OF THE INVENTION

All temperatures herein are in degrees Celsius (° C.) unless otherwise indicated. As used herein, the term "comprising" means that other steps, ingredients, elements, etc. which do not adversely affect the end result can be added. This term encompasses the terms "consisting of" and "consisting essentially of". All conditions herein are at 20° C., and atmospheric pressure unless otherwise specifically stated. Unless otherwise specifically stated, the ingredients and equipment herein are believed to be widely available from multiple suppliers and sources around the world. All polymer molecular weights are by average number molecular weight unless otherwise specifically noted.

As used herein, "suds" indicates the non-equilibrium dispersion of gas bubbles in a relatively smaller volume of a liquid such as "foam" or "lather".

This disclosure concerns an alkaline laundry detergent for hand washing a fabric. The laundry detergent contains an anionic surfactant, a polyethyleimine suds collapser as described, and a pH control system. The laundry detergent is alkaline during use, typically providing an in-use pH of above 8, or from about 9 to about 13, or from about 9.5 to about 11.5, or from about 10 to about 11. Before dilution to form the laundry liquor the alkaline detergent composition may be in any form, typically a solid granule, a liquid, a tablet, a bar, or a gel.

Sudsing Surfactant

The sudsing surfactant useful herein is typically the workhorse surfactant, removing dirt and soils from the laundry and forming voluminous, and/or resilient suds during normal use. Thus, the sudsing surfactant typically has a sudsing profile of at least about 5 cm, or from about 8 cm to 25 cm, as measured by the below Suds Testing Protocol herein. The level of sudsing surfactant is from about 0.5% to about 50%, or from about 1% to about 40%, or from about 2% to about 30% by weight of the liquid laundry detergent. Since consumers continue to desire to see some suds on the surface of the laundry liquor, it is beneficial to provide a sudsing surfactant.

In an embodiment herein, the sudsing surfactant comprises an anionic moiety, or multiple anionic moieties. Without intending to be limited by theory, it is believed that an anionic moiety allows the sudsing surfactant to attract the PEI suds collapser so that the sudsing surfactant is pulled from the suds. This in turn reduces the sudsing surfactant available to maintain suds in the rinse, and initiates a significantly faster suds collapse. In an embodiment herein the sudsing surfactant is selected from the group consisting of an anionic surfactant, a zwitterionic surfactant, and a combination thereof, or an anionic surfactant. In an embodiment the sudsing surfactant is an anionic surfactant well-known in detergents and has an alkyl chain length of from about 6 carbon atoms ($C_6$), to about 22 carbon atoms ($C_{22}$), or from about $C_{12}$ to about $C_{18}$. Upon physical agitation, anionic surfactants form suds at the air-water interface. Suds indicate to consumers that surfactant is present to release soils, oils, etc. Non-limiting anionic surfactants herein include:

a) linear alkyl benzene sulfonates (LAS), or $C_{11}$-$C_{18}$ LAS;

b) primary, branched-chain and random alkyl sulfates (AS), or $C_{10}$-$C_{20}$ AS;

c) secondary (2,3) alkyl sulfates having formulas (I) and (II), or $C_{10}$-$C_{18}$ secondary alkyl sulfates:

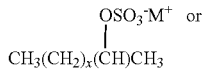

(I)

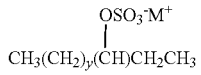

(II)

M in formulas (I) and (II) is hydrogen or a cation which provides charge neutrality such as sodium, potassium, and/or ammonium. Above, x is from about 7 to about 19, or about 9 to about 15; and y is from about 8 to about 18, or from about 9 to about 14;

d) alkyl alkoxy sulfates, and alkyl ethoxy sulfates ($AE_xS$), or $C_{10}$-$C_{18}$ $AE_xS$ where x is from about 1 to about 30, or from about 2 to about 10;

e) alkyl alkoxy carboxylates, or $C_6$-$C_{18}$ alkyl alkoxy carboxylates, or those with about 1-5 ethoxy (EO) units;

f) mid-chain branched alkyl sulfates as discussed in U.S. Pat. No. 6,020,303 to Cripe, et al., granted on Feb. 1, 2000; and U.S. Pat. No. 6,060,443 to Cripe, et al., granted on May 9, 2000;

g) mid-chain branched alkyl alkoxy sulfates as discussed in U.S. Pat. No. 6,008,181 to Cripe, et al., granted on Dec. 28, 1999; and U.S. Pat. No. 6,020,303 to Cripe, et al., granted on Feb. 1, 2000;

h) methyl ester sulfonate (MES); and i) primary, branched chain and random alkyl or alkenyl carboxylates, or those having from about 6 to about 18 carbon atoms.

In an embodiment herein, the anionic surfactant contains a mixture of anionic surfactants.

The anionic surfactant herein is typically present at from about 1% to about 50%, or from about 3% to about 40%, or from about 5% to about 30%. The anionic surfactant may be a water-soluble salt, or an alkali metal salt, or a sodium and/or potassium salt.

Suds boosting co-surfactants may also be used to boost suds during the washing procedure. Many such suds boosting co-surfactants are often also anionic surfactants, and are included in the total anionic surfactant above.

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants; betaine, including alkyl dimethyl betaine and cocodimethyl amidopropyl betaine, $C_8$ to $C_{18}$ (or $C_{12}$ to $C_{18}$) amine oxides and sulfo and hydroxy betaines, such as N-alkyl-N,N-dimethylammino-1-propane sulfonate where the alkyl group can be $C_8$ to $C_{18}$, or $C_{10}$ to $C_{14}$.

The amphoteric surfactant herein is selected from water-soluble amine oxide surfactants, including amine oxides containing one $C_{10-18}$ alkyl moiety and 2 moieties selected from $C_{1-3}$ alkyl groups and $C_{1-3}$ hydroxyalkyl groups; phosphine oxides containing one $C_{10-18}$ alkyl moiety and 2 moieties selected from $C_{1-3}$ alkyl groups and $C_{1-3}$ hydroxyalkyl groups; and sulfoxides containing one $C_{10-18}$ alkyl moiety and a moiety selected from $C_{1-3}$ alkyl and $C_{1-3}$ hydroxyalkyl moieties.

A useful amine oxide surfactant is:

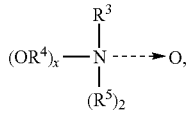

where $R^3$ is a $C_{8-22}$ alkyl, a $C_{8-22}$ hydroxyalkyl, or a $C_{8-22}$ alkyl phenyl group; each $R^4$ is a $C_{2-3}$ alkylene, or a $C_{2-32}$ hydroxyalkylene group; x is from 0 to about 3; and each $R^5$ is a $C_{1-3}$ alkyl, a $C_{1-3}$ hydroxyalkyl, or a polyethylene oxide containing from about 1 to about 3 EOs. The $R^5$ groups may form a ring structure, e.g., through an oxygen or nitrogen atom, to. The amine oxide surfactant may be a $C_{10-18}$ alkyl dimethyl amine oxide and/or a $C_{8-12}$ alkoxy ethyl dihydroxy ethyl amine oxide.

A useful propyl amine oxide is:

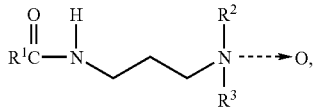

where $R^1$ is a alkyl, 2-hydroxy $C_{8-18}$ alkyl, 3-hydroxy $C_{8-18}$ alkyl, or 3-$C_{8-18}$ alkoxy-2-hydroxypropyl; $R^2$ and $R^3$ are each methyl, ethyl, propyl, isopropyl, 2-hydroxyethyl, 2-hydroxypropyl, or 3-hydroxypropyl and n is 0-10.

Also useful is:

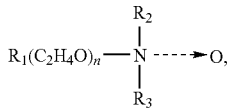

where $R^1$ is a $C_{8-18}$ alkyl, 2-hydroxy $C_{8-18}$ alkyl, 3-hydroxy $C_{8-18}$ alkyl, or 3-$C_{8-18}$ alkoxy-2-hydroxypropyl; and $R^2$, $R^3$ and n are as defined above.

Non-limiting amphoteric surfactants useful herein are known in the art and include amido propyl betaines and derivatives of aliphatic or heterocyclic secondary and ternary amines with a straight chain, or branched aliphatic moiety and wherein one of the aliphatic substituents are $C_{8-24}$ and at least one aliphatic substituent contains an anionic water-soluble group.

In an embodiment herein, the sudsing surfactant contains a gemini surfactant.

PEI Suds Collapser

The PEI suds collapser is an ingredient or a system containing a polyethyleneimine (PEI) polymer which causes the suds to collapse at a predetermined time, typically during the rinse. Thus, the PEI suds collapser differs from traditional suds suppressors, as the PEI suds collapser is not suppressing suds the entire time, but is instead triggered by an event or a condition, for example, a pH change, to cause the suds in the laundry liquor, rinse, fabric, and/or on the fabric to collapse, burst and/or otherwise remove them from perception at a faster rate than if the PEI suds collapser is not present, or is not activated. In contrast a suds suppressor, such as a silicone suds suppressor, decreases suds during the entire washing and rinsing process. Not wishing to be bound by theory, it is believed that in alkaline wash conditions, the pH of the laundry liquor is typically above 8, where the nitrogen moieties in the PEI suds collapser are typically not protonated. In this unprotonated state the PEI does not react with or affect the sudsing and cleaning ability of the sudsing surfactant. However, during the rinse cycle the laundry liquor is removed (or the clothes are removed from the laundry liquor) and rinse water is added. Without intending to be limited by theory, it is believed that this dilution results in a pH drop, driving the solution pH to the point where the PEI suds collapser's nitrogens become mildly or highly protonated, resulting in a net positive charge on the PEI suds collapser. This positively charged PEI Suds collapser can then attract and/or complex with the negative charge on the sudsing surfactant, thereby pulling it away from the air-surface interface, the solution and/or the fabric interface as well. The complex can be a loosely associated ion pair, a coacervate, a bound complex, etc. In any of these cases, the sudsing surfactant is no longer surface active and therefore, will not serve to stabilize foam. As a result the suds will collapse faster, and there is a reduced need for rinsing. This in turn saves water, effort and natural resources.

The PEI suds collapser herein is a modified PEI such as that shown in the empirical Formula 1 below. Formula 1 is an empirical formula showing the relative amounts of each of the constituents, and is not intended to indicate the structural order of the different moieties.

$$(PEI)_a EO)_b(PO)_c \qquad \text{Formula 1:}$$

where a represents the average number-average molecular weight, $MW_n$, of the PEI backbone prior to modification and may range from about 100 to about 100,000, or from about 300 to about 20,000, or from about 450 to about 10,000. b represents the average number of ethylene oxide ("EO") units per nitrogen atom in the PEI backbone core and may range from 0 to about 60, or from about 5 to about 50, or from about 8 to about 40, or from about 10 to about 35. c represents the average number of propylene oxide ("PO") units per nitrogen atom in the PEI backbone core and may range from 0 to about 60, or from about 2 to about 20, or from about 3 to about 10, or from about 3 to about 7.

In an embodiment herein, the PEI suds collapser is a polyethyleneimine corresponding to Formula I having a PEI backbone core with an average number-average molecular weight of about 600 which is ethoxylated to a level of about 30 ethylene oxide per PEI nitrogen atoms and propoxylated to a level of about 5 propylene oxide units per PEI nitrogen atoms. This embodiment may be represented by the empirical formula $(PEI)_{600}(EO)_{30}(PO)_5$. The modified PEI suds collapser of the present invention may be produced by processes described in WO 2006/108856 A1.

The PEI suds collapser herein is different from the PEIs known in the laundry art as soil dispersants and for their anti-redeposition properties in that these compounds are designed to interact with hydrophobic soils and solids. In contrast, the PEI suds collapser herein is designed to have minimal interaction with hydrophobic soils. The hydrophobic odification can strengthen the sudsing surfactant-polymer interaction so that PEI can primary work on surfactants rather than soils.

These modified PEIs have a very special protonation behavior due to the neighboring effect which is not well understood in the art. See, for example. *Polyethyleneimine—Physiochemical Properties and Applications*, by D. Horn, "Polymeric amines and ammonium salts" (E. J. Goethals, ed.), pp. 333-54, Perjamon Press, Oxford, 1980. Accordingly, a single pKa, or even a series of well-defined pKas is not suitable to describe the protonation behavior of such complex molecules.

The PEI suds collapser is typically present at from about 0.05% to about 5%, or from about 0.2% to about 3%, or from about 0.3% to about 2% by weight of the laundry detergent. Without intending to be limited by theory, it is believed that the PEI suds collapser herein may reduce initial suds in the rinse by at least about 25%, or from about 25% to about 100%, or from about 50% to about 100%, or from about 60% to about 100%, as compared to when no PEI suds collapser is present.

pH Control System

The pH control system herein forms a buffering system which keeps the pH alkaline when the laundry detergent is being used to wash clothes. The alkaline pH significantly improves cleaning performance against a variety of common soils such as greasy soils and body soils. The pH control system purpose is to maintain the pH of the laundry liquor above about 8, or from about 9 to about 13, or from about 9.5 to about 11.5, or from about 10 to about 11. The pH control system herein may contain both acids and bases to form a pH buffer system, for example, the sodium and/or potassium salts of carbonate, bicarbonate, citrate, silicate, hydroxide, and a combination thereof, or sodium carbonate, sodium silicate, sodium bicarbonate, and sodium hydroxide.

It is believed however, that in the rinse cycle the pH control system breaks down due to excessive dilution, and the pH of the rinse bath returns to the water's natural pH, or close thereto, during successive rinses, as each rinse dilutes the pH control system further and further. Without intending to be limited by theory, it is believed that the due to the relatively larger molecular weight of the PEI suds collapser, it is carried over into the rinse proportionally more than lower molecular weight compounds which would instead be more water soluble. Hydrophobically-modified PEI suds collapsers further enhance this effect. As such, the PEI suds collapsers are present in a relatively greater concentration in the rinse bath to attract and/or complex with the sudsing surfactant, and remove it from the air-water interface, and instead wash away.

It is believed that the lower the pH, the higher the charge density and therefore more effective the PEI suds collapser is; the lower pH allows the PEI suds collapser's nitrogens to become protonated as the pH of the rinse water falls. Thus, it is believed that the combination of an alkaline pH and the PEI suds collapser provide an unexpected synergy which is completely lacking in prior publications which discuss the use of fatty acids as suds collapsers in an acidic washing environment. In the rinse bath, the pH is typically less than about 9, or from about 6.5 to about 9, or from about 6.9 to about 8.6. More particularly, the first rinse bath after the fabric is removed from the laundry liquor will often have a higher pH than successive rinse baths due to carry-over alkalinity from the laundry liquor. However, the pH decreases with each successive rinse bath so that the pH of the final rinse bath approaches the natural pH of the water used, which should be around 7.

Rinsing pH is controlled by controlling reserve alkalinity of products to pH 9. reserve alkalinity is defined as the grams of NaOH per 100 grams, exceeding pH 9 in the product. Granular products are analyzed using a 0.4% solution. HCl to titrate and determine the reserve alkalinity. The milliequivalent amount of HCl to pH 9 is measured and the alkalinity to pH 9 (or reserve alkalinity) is calculated. It is expressed on a balance basis as grams NaOH per 100 g product. In order to control rinse pH, reserve alkalinity may be less than about 15 g NaOH/100 g product, or from about 0.001 to about 15 g NaOH/100 g product, or from about 0.01 g NaOH/100 g product to about 12 g NaOH/100 g product, or from about 0.1 g NaOH/100 g product to about 10 g NaOH/100 g product.

Additional Detergent Ingredients

The alkaline detergent composition typically contains a builder, or an inorganic builder therein. The inorganic builder is typically selected from the group consisting of a phosphate builder, a silicate builder, a zeolite builder, and a mixture thereof. The phosphate builder herein includes the alkali metal, ammonium and alkanolammonium salts of poly-, ortho- and/or meta-phosphate; or the alkali metal salts of poly-, ortho- and/or meta-phosphate; or the sodium and potassium salts of poly-, ortho- and/or meta-phosphate; or sodium tripolyphosphate (STPP).

The inorganic builder includes an alkali metal silicate, a zeolite, and a mixture thereof. Both sheet silicates and amorphous silicates are useful herein as are zeolite A, zeolite X, zeolite P, zeolite MAP, and a mixture thereof. The detergent composition typically contains from about 1% to about 40%, or from about 3% to about 35%, or from about 5% to about 30% builder.

The balance of the laundry detergent typically contains from about 5% to about 70%, or about 10% to about 60% adjunct ingredients such as a bleach, a polymer, a bluing agent, a brightener, a chelant, an enzyme, a perfume, a non-anionic surfactant, a suds suppressor, etc. which are well known in the art.

A bluing agent is typically a slightly bluish dye and/or pigment which attaches to fabrics and which thereby helps to hide yellowish tinges and colors on fabrics so as to make the fabric appear whiter. Bluing agents suitable for use herein include: Polar Brilliant Blue GAW 180 percent sold by Ciba-Geigy S.A., Basel, Switzerland (similar to C.I. ["Color Index"] 61135-Acid Blue 127); FD&C Blue No. 1 (C.I. 42090), Rhodamine BM (C.I. 45170); Pontacyl Light Yellow 36 (similar to C.I. 18820); Acid yellow 23; Pigmasol blue; Acid blue 3; Polar Brilliant Blue RAW (C.I. 61585—Acid Blue 80); Phthalocyanine Blue (C.I. 74160); Phthalocyanine Green (C.I. 74260); and Ultramarine Blue (C.I. 77007-Pigment Blue 29). Additional examples of suitable bluing agents are described in U.S. Pat. No. 3,931,037 issued Jan. 6, 1976 to Hall and U.S. Pat. No. 5,605,883 issued Feb. 25, 1997 to Iliff, et al. In an embodiment herein the bluing agent is ultramarine blue which is available form a variety of suppliers, worldwide.

Brighteners convert non-visible light into visible light thereby making fabric and clothes appear brighter, whiter and/or their colors more vibrant. Non-limiting examples of brighteners useful herein include brightener 15, brightener 49, brightener, manufactured by Ciba Geigy, Paramount, Shanghai Yulong and others. Bluing agents and brighteners are typically present at levels of from about 0.005% to about 3%.

The chelant useful herein are selected from all compounds in any suitable amount or form that bind with metal ions to control the adverse effects of heavy metal contamination or water hardness (for example, calcium and magnesium ions) in an aqueous bath. Any multidentate ligand is suitable as a chelating agent. For example, suitable chelating agents can include, but are not limited to a carboxylate, a phosphate, a phosphonate, a polyfunctionally-substituted aromatic compound, a polyamine, the alkali metal, ammonium or substituted ammonium salts or complexes of these chelating agents, and a mixture thereof.

Enzymes useful herein include lipases, proteases, amylases ($\alpha$ and/or $\beta$), cellulases, cutinases, esterase, carbohydrases, peroxidases, laccases, oxygenases, etc., including modified/genetically-engineered enzymes and stabilized enzymes. The enzyme levels of such other enzymes are generally from about 0.0001% to about 2%, or from about 0.001% to about 0.2%, or from about 0.005% to about 0.1% pure enzyme.

The perfume herein provides aesthetic impact to the fabric either during or after laundering. Perfumes are available from, e.g., Givaudan, International Flavors & Fragrances, etc., and are typically present at from about 0.001% to about 5%, or from about 0.01% to about 3%, or from about 0.1% to about 2.5%.

Non-anionic surfactants useful herein include cationic surfactants or nonionic surfactants. Such surfactants are well-known for use in laundry detergents and are typically present at levels of from about 0.5% to about 50%, or from about 1% to about 40%.

The suds suppressor useful herein is a traditional suds suppressor which continuously decreases suds during all parts of the washing and rinsing cycle. In an embodiment herein, the suds suppressor is a silicone-containing suds suppressor and can be any silicone-containing suds suppressor or a mixture of thereof which disrupts the surfactant at the air-water interface causing the suds to collapse more easily and/or quickly. The suds suppressor may be present at from about 0.001% to about 0.1%, or from about 0.001% to about 0.05% or from about 0.002% to about 0.02% by weight of the laundry detergent, when measured as the weight of active suds suppressor, excluding any carriers or other materials not having a suds suppressing effect.

Testing Methods:

pH

A standard pH meter is used to measure the pH. It is believed that pH testing methods and apparatuses are so standardized, that one skilled in the art would understand how to reliably test the pH of a given solution. Typically the pH meter is calibrated to the desired pH range (e.g., from pH 6 to pH 10) according to the manufacturer's instructions prior to use.

The pH should generally be measured at the dilution of actual use as recommended by the detergent manufacturer. However, as such dilutions vary widely, a standard dilution herein is a ratio of detergent to water of 1:350 by weight. The pH is taken at 20° C. Unless otherwise specifically stated, the pH is measured neat.

Suds Testing

The Suds Testing Protocol employs a suds tube machine (Tumbling Tube) with 8 transparent acrylic cylindrical tubes (height 30 cm; inner diameter 9 cm; outer diameter 10 cm) removably set in a rigid metal frame connected with an electrical motor that rotates the tubes end-over-end about their midpoints at a fixed speed of 30 (±3) rpm. The tubes' stoppers are removable and water-tight. The scales for reading the suds level are self-adhesive strips pre-graduated in centimeters with O-cm leveled at the liquid surface height of 300 mL water.

To clean each tube thoroughly before each use: A) Empty the tube, fill it with hot water, seal the open end with a stopper and shake the tube vigorously. Use a scrubbing brush or sponge if needed. Empty and repeat. B) If no silicone-containing composition has been tested in the tube then go to step C); when a silicone-containing composition has been in the tube, add a small amount of $Na_2CO_3$, fill with hot water and shake vigorously to eliminate any residual silicone. Empty tube. C) Add 1-2 ml "Dreft" or similar-concentrated dish-washing liquid to each tube. Fill tubes ¾ with hot water, seal open end with stopper, and shake vigorously. Empty tubes. D) Fill tubes ¾ with hot water, seal open end with stopper, and shake vigorously. Empty tubes and repeat. On last emptying, hold tube upside-down and view ring of liquid along inner surface of tube. Hold tube steady. The liquid ring should move uniformly down the tube without breaking. A break indicates an impurity in or on the tube surface. In case the liquid ring breaks, repeat Step D until the ring does not break.

Reagents & Solutions: water (25° C.; hardness=150 ppm of $Ca^{2+}$:$Mg^{2+}$ at a 4:1 molar ratio), the liquid detergent composition herein containing the PEI suds collapser, the sudsing surfactant, or whatever is being tested (i.e., the test composition), and an identical liquid detergent composition lacking PEI suds collapser, sudsing surfactant, or whatever is being tested against (i.e., the control composition). In the control composition, the missing PEI suds collapser, sudsing surfactant, etc. is replaced with deionized water. To simulate rinsing conditions, the appropriate test or control composition is diluted 1:7 (a dilution factor of 8) with hardness water.

The test is always performed with 3 replicates per composition. To minimize systematic errors, 6 out of 8 tubes are labeled for the test composition and the remaining 2 tubes are labeled for the control composition. When the test is repeated, the labels are switched.

Predissolve detergent mix (either test or control, as per the labels) into 300 mL hardness water and fill them into the 8 tubes accordingly. Repeat for each tube, insert stoppers, and insert into metal frame. Spin for 80 revolutions. Stop the rotation and wait 1 minute. Record the highest suds height in cm (not including any residue on cylinder walls). Clean the tubes per the cleaning protocol. Switch the labels on the tubes and repeat the test so as to generate 3 replicates of each composition, with each tube placed in the same position on the rigid metal frame during the first and second runs.

During a rinse simulation, the tubes are spun for only 15 revolutions, to better approximate real consumer habits.

The sudsing surfactant typically has a sudsing profile of at least about 5 cm, or from about 7 cm to 25 cm (at the level added to the laundry detergent), as measured by the Suds Testing Protocol. This is measured directly after the test is run.

Method of Use:

The laundry detergents herein are especially well-suited for use in a hand-washing context and in hard water conditions where the water hardness is between about 10 ppm to about 600 ppm; or from about 15 ppm to about 340 ppm; or from about 17 ppm to about 300 ppm, or from about 20 ppm to about 230 ppm of hard water ions such as $Ca^{2+}$, $Mg^{2+}$, etc., or such as $Ca^{2+}$ and/or $Mg^{2+}$. For hand-washing, the laundry detergent is typically diluted by a factor of from about 1:150 to about 1:1000, or about 1:200 to about 1:500 by weight, by placing the laundry detergent in a container along with wash water to form a laundry liquor. The container is typically square, rectangular, oval or round and is wider than it is deep. The wash water used to form the laundry liquor is typically whatever water is easily available, such as tap water, river water, well water, etc. The temperature of the wash water may range from about 2° C. to about 50° C., or from about 5° C. to about 40° C., or from 10° C. to 40° C., although higher temperatures may be used for soaking and/or pretreating.

The laundry detergent and wash water is usually agitated to evenly disperse and/or either partially or completely dissolve the detergent and thereby form a laundry liquor. Such agitation forms suds, typically voluminous and creamy suds. The dirty laundry is added to the laundry liquor and optionally soaked for a period of time. Such soaking in the laundry liquor may be overnight, or for from about 1 minute to about 12 hours, or from about 5 minutes to about 6 hours, or from about 10 minutes to about 2 hours. In a variation herein, the laundry is added to the container either before or after the wash water, and then the laundry detergent is added to the container, either before or after the wash water.

The method herein optionally includes a pre-treating step where the user pre-treats the laundry with the laundry detergent to form pre-treated laundry. In such a pre-treating step, the laundry detergent may be added directly to the laundry to form the pre-treated laundry, which may then be optionally scrubbed, for example, with a brush, rubbed against a surface, or against itself before being added to the wash water and/or the laundry liquor. Where the pre-treated laundry is added to water, then the diluting step may occur as the laundry detergent from the pre-treated laundry mixes with the wash water to form the laundry liquor.

The laundry is then hand-washed by the user who typically kneels next to, sits next to or leans over the container. Once the laundry is hand-washed, then the laundry may be wrung out and put aside while the laundry liquor is either used for additional laundry, poured out, etc. The same container may be used for both hand-washing the laundry and rinsing the laundry. Thus, the laundry liquor may often be emptied from the container, so that rinse water (often from the same source as the wash water) may be added; or a separate rinse container or area may be used. In cases where a rinse container is used, the laundry and rinse water are added either one after another or concurrently to form a rinse bath, and then it is common practice to agitate the laundry to remove the surfactant residue. Without intending to be limited by theory, it is believed that the PEI suds collapser may also reduce the formation of new suds during such agitation.

The laundry may be soaked in the rinse water and then wrung out and put aside. The used rinse water is typically discarded and new rinse water is prepared. This rinsing step is repeated until the user subjectively judges that the laundry is clean—which typically means "until no more suds are present on the rinse water." It has been found that with a typical hand-washing liquid laundry detergent, the user will rinse a total of from about 3 to about 6 times. However, it has been found that suds on the rinse water is not necessarily an accurate measurement of when the surfactant is actually removed from the laundry, because visible suds may be caused by the residual laundry liquor in the container, suds physically sticking to the fabric, etc.

With the laundry detergent herein, the PEI suds collapser can reduce the perceived need for many rinses by reducing the suds present during the rinse cycle. Thus, the actual number of rinses with the liquid laundry detergent herein should be reduced, and may better correspond with the actual number needed to remove an acceptable level of surfactant residue. This decreased rinsing saves significant water, effort and resources. In fact, it has been surprisingly found that the average number of rinses using the invention may be half, or one third of the number of rinses using a comparable product lacking the silicone-containing suds suppression system. The number of rinses when using the liquid laundry detergent herein is typically from about 1 to about 3, or from about 1 to about 2. In an embodiment herein, the user may add to one or more rinses a fabric conditioner, a fabric softener, a laundry sour, etc. as desired.

Detergent Form and Process for Making:

The laundry detergent herein is typically in the form of a water-soluble granule formed by agglomeration and/or spray drying. Such a granular laundry detergent is usually composed of particles having a weight-average particle size (diameter) of from about 50μ to about 3 mm, or from about 100μ to about 1 mm. In an embodiment herein the laundry detergent is in the form of a liquid or a gel, which may be either structured or an unstructured. Manufacturing processes for such laundry detergents may be either batch or continuous and are well-known in the art.

EXAMPLE 1

A PEI suds collapser having the empirical formula $(PEI_{600}(EO)_{30}(PO)_5$ is spiked into a commercial detergent composition at 1%, whereas a control composition has 1% water spiked in. The sudsing profile according to the Suds Testing Protocol is virtually identical during simulated washing conditions. However, during the simulated rinsing conditions, the suds level of the test composition is less than half of the control composition. Suds volume is measured as suds height via the Suds Testing Protocol. Results are summarized in Table 1.

EXAMPLE 2

A PEI suds collapser having the empirical formula of $(PEI)_{600}(EO)_{24}(PO)_{16}$ is spiked into a commercial detergent as per Example 1, above. The sudsing profile according to the Suds Testing Protocol is virtually identical during simulated washing conditions. However, during the simulated rinsing conditions, the suds level of the test composition is less than half of the control composition. Suds volume is measured as suds height via the Suds Testing Protocol. Results are summarized in Table 1.

EXAMPLE 3

A PEI suds collapser having the empirical formula of $(PEI)_{5000}(EO)_{10}(PO)_7$ is spiked into a commercial detergent as per Example 1, above. The sudsing profile according to the Suds Testing Protocol is virtually identical during simulated washing conditions. However, during the simulated rinsing conditions, the suds level of the test composition is less than half of the control composition. Suds volume is measured as suds height via the Suds Testing Protocol. Results are summarized in Table 1.

EXAMPLE 4

A PEI suds collapser having the empirical formula of $(PEI)_{600}(EO)_{10}(PO)_7$ is spiked into a commercial detergent as per Example 1, above. The sudsing profile according to the Suds Testing Protocol is virtually identical during simulated washing conditions. However, during the simulated rinsing conditions, the suds level of the test composition is less than half of the control composition. Suds volume is measured as suds height via the Suds Testing Protocol. Results are summarized in Table 1.

COMPARATIVE EXAMPLE

A PEI suds collapser having the empirical formula of $(PEI)_{600}(EO)_0(PO)_0$—i.e., this is a regular PEI with no ethoxylations and no propoxylations—is spiked into a commercial detergent as per Example 1, above. The sudsing profile according to the Suds Testing Protocol is very low during both simulated washing conditions and simulated rinsing conditions. Suds volume is measured as suds height via the Suds Testing Protocol. Results are summarized in Table 1.

TABLE 1

Suds Testing Protocol Suds Height Measurement for PEIs

| Sample | Suds Height in Simulated First Rinse (cm) |
|---|---|
| Benchmark- No PEI | 7.9 |
| $(PEI)_{600}(EO)_{30}(PO)_5$ | 4.0 |
| $(PEI)_{600}(EO)_{24}(PO)_{16}$ | 5.2 |
| $(PEI)_{5000}(EO)_{10}(PO)_7$ | 4.4 |
| $(PEI)_{600}(EO)_{10}(PO)_7$ | 4.3 |
| $(PEI)_{600}(EO)_0(PO)_0$ | 1.0 |

Lower rinsing suds height compared to benchmark (e.g. 4.0 cm vs. 7.9 cm) indicates suds suppression delivered by the PEI suds collapser during the first rinse. Accordingly, the data shows a PEI-containing detergent according to the present invention provides suds suppression activity in the rinse, while not significantly affecting suds in the laundry liquor.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An alkaline granular laundry detergent for hand washing a fabric comprising:

a. a sudsing surfactant;

b. a polyethyleneimine suds collapser corresponding to the empirical formula:

$$(PEI)_{600}(EO)_{30}(PO)_5;$$

and c. a pH control system, wherein during dilution to form a laundry liquor and during washing, the pH control system maintains the pH of the laundry liquor above about 8;

wherein said detergent has a reserve alkalinity of from about 0.1 to about 10 g NaOH/100 g of detergent.

2. The laundry detergent according to claim 1, wherein the pH control system maintains the pH during the wash from about 9 to about 13.

3. The laundry detergent according to claim 1, wherein the sudsing surfactant comprises an anionic surfactant.

4. The laundry detergent according to claim 1, further comprising an additional detergent ingredient selected from the group consisting of a polymer, brightener, a bluing agent, a chelant, an enzyme, a perfume, a non-anionic surfactant, a suds suppressor and a mixture thereof.

5. The laundry detergent according to claim 1, further comprising a builder.

6. The laundry detergent according to claim 4, wherein the non-anionic surfactant is selected from the group consisting of a nonionic surfactant, a cationic surfactant, and a mixture thereof.

7. A method of hand washing a fabric comprising the steps of:

A. providing a laundry detergent according to claim 1;

B. forming a laundry liquor by diluting the laundry detergent with water at a weight ratio of from about 1:150 to about 1:1000, wherein the laundry liquor has a pH maintained at above about 9;

C. hand washing a fabric in the laundry liquor;

D. maintaining pH of the laundry liquor above about 8 during the washing step; and E. rinsing the laundry in a rinse bath, wherein the pH of the rinse bath is below about 9.

8. The method of hand washing a fabric according to claim 7, wherein the PEI suds collapser forms an ion pair with the sudsing surfactant during the rinsing step.

9. The method of hand washing a fabric according to claim 7, wherein the pH of the laundry liquor is maintained at from about 9 to about 13, and wherein the pH of the rinse bath is less than about 9.

10. A method of saving water comprising the step of washing a fabric according to the method of claim 7.

* * * * *